US005089302A

United States Patent [19]

Ruddick et al.

[11] Patent Number: 5,089,302

[45] Date of Patent: Feb. 18, 1992

[54] PROCESS FOR FIXING WOODEN ARTICLES PRESSURE TREATED WITH CHROMATED-COPPER-ARSENATE

[75] Inventors: John N. R. Ruddick; George H. Eaton, both of West Vancouver; Douglas B. Whiting, Lumby, all of Canada

[73] Assignee: Bell Pole Co. Ltd., British Columbia, Canada

[21] Appl. No.: 647,690

[22] Filed: Jan. 28, 1991

Related U.S. Application Data

[63] Continuation of Ser. No. 346,639, May 3, 1989, abandoned.

[30] Foreign Application Priority Data

Mar. 7, 1989 [CA] Canada ..... 593023

[51] Int. Cl.[5] ..... B05D 3/04

[52] U.S. Cl. ..... 427/377; 427/343; 427/297; 427/440

[58] Field of Search ..... 427/297, 343, 377, 440

[56] References Cited

U.S. PATENT DOCUMENTS 4,017,980 4/1977 Kleinguenther ..... 427/325

4,325,993 4/1982 Schroder ..... 427/382

4,716,054 12/1987 Stanek et al. .

FOREIGN PATENT DOCUMENTS 70025789 8/1970 Japan .

OTHER PUBLICATIONS

"Fundamentals on Steam Fixation of Chromated Wood Preservatives", by R. D. Peek et al., presented at Nineteen Annual Meeting of the International Research Group on Wood Preservation, Madrid, Spain, Apr. 24–29, 1988.

*Primary Examiner*—Janyce Bell

*Attorney, Agent, or Firm*—Barrigar & Oyen

[57] ABSTRACT

This invention is directed to a process for accelerating the fixation of chromated-copper-arsenate (CCA) preservative in wooden articles. The invention particularly pertains to a process of fixing CCA in softwoods such as lodgepole pine, so that it does not leach. A process of fixing chromated-preservatives in freshly treated wood by applying moderate heat to the treated wood while initially maintaining the treated wood in a highly humid or saturated atmosphere, and subsequently maintaining the atmosphere about the freshly treated wood at a controlled equilibrium moisture content level.

15 Claims, 1 Drawing Sheet

CHARGE Nº 10 WET BULB CONTROL

CHARGE Nº 10 WET BULB CONTROL

CHARGE Nº 11 DRY BULB CONTROL

PROCESS FOR FIXING WOODEN ARTICLES PRESSURE TREATED WITH CHROMATED-COPPER-ARSENATE

CROSS REFERENCE TO RELATED APPLICATIONS

This is a continuation of application Ser. No. 07/346,639, filed May 3, 1989, now abandoned.

FIELD OF THE INVENTION

This invention is directed to a process for accelerating the fixation of chromated-copper-arsenate (CCA) preservative in wooden articles. The invention particularly pertains to a process of fixing CCA in softwoods such as lodgepole pine so that it does not leach.

BACKGROUND OF THE INVENTION

Chromated-copper-arsenate (CCA) is widely used to preserve wooden articles, particularly those produced from softwoods such as lodgepole white, jack and red pine. The CCA is applied to the wood under pressure so that it penetrates below the surface of the wood. Under ideal conditions, the CCA bonds with the cellulose by undergoing a chemical reaction (the chromium undergoes a valence change from the hexavalent to the trivalent state) and is rendered insoluble in the wood in a relatively short period of time, after which the CCA does not leach out under normal conditions. Study has suggested that several weeks are required to ensure fixation of CCA on wooden poles under normal temperate climatic conditions. In winter, the fixation period can extend over several months. Environmental contamination at wood preserving plants has been the focus of considerable attention, internationally.

In Canada, Environment Canada has funded a major cooperative project involving the wood treating industry. The project included those responsible for regulating the use of wood preservatives, namely scientists, and health and safety authorities. Key recommendations identified in the document relate to the design of wood preserving facilities in order to minimize potential for environmental contamination. These recommendations include under-cover storage to hold freshly treated wood until fixation of chromated-copper-arsenate (CCA) preservative has been completed. Since the fixation reaction is temperature dependent, long storage times may be anticipated during winter months before CCA treated wood can be released for use.

Current industrial practice for CCA-treated timber and roundwood is to hold the freshly wood under covered storage for a period up to forty eight hours. There is little evidence to indicate that this time period provides an adequate CCA fixing time. If the product is placed in open storage before fixation is complete, loss of preservative components, particularly those at the surface of the wood, will result in serious ground contamination and reduced timber and pole performance in the field.

A potential approach to solving this problem is to accelerate the fixation in some way, such as applying post-treatment heat. Such a procedure could have the added benefit of partially drying the poles, prior to their being placed in outdoor storage. This approach could also be beneficial in that it would reduce the storage time required for the moisture content of the poles to reach levels specified by utility companies prior to delivery. Applying moderate heat to the treated poles could effectively eliminate ground contamination in the storage yard, reduce the storage space requirements and reduce inventory costs.

Unfortunately, other factors such as excessive surface hardness and wood checking characteristics, which also impact on the acceptability of CCA-treated poles, may be detrimentally affected by the heating process.

Certain patents illustrate procedures which are potentially relevant to this field of technology. U.S. Pat. No. 4,716,054 discloses a two-stage process for the accelerated fixing of chromate-containing wood preservative salts in which freshly impregnated timbers are subjected to fixing with superheated steam. The process is carried out by subjecting the freshly impregnated poles to a dry heat treatment in which the wood surface is heated to 60°–100° Celsius, (140° F. to 212° F.) preferably 80°–95° Celsius (180° F.–205° F.). The poles are then treated with superheated steam. The chromated wood preservative salt disclosed is chromium-copper-boron.

Japanese patent No. 70025789 discloses a method of fixing a preservative in wood. The method comprises impregnating wood with a preservative containing chromium, copper and arsenate by pressure or the like and heating the impregnated wood with steam of a temperature less than 150 degrees C. to rapidly fix the preservative in the wood. This Japanese patent does not discuss relative humidity factors which have an important effect in ensuring successful fixing of the chromium-copper-arsenate with the wood.

A publication that may have some relevance to the invention is an article entitled "Fundamentals on Steam Fixation of Chromated Wood Preservatives" by R. D. Peek at al. presented at the Nineteenth Annual Meeting of The International Research Group on Wood Preservation, Madrid, 24–29 April 1988, Spain.

SUMMARY OF THE INVENTION

The invention pertains to a process of fixing a chromated-preservative in freshly treated wood by applying moderate heat to the chromated-preservative treated wood while initially maintaining the treated wood in a highly humid or saturated atmosphere, and subsequently maintaining the atmosphere about the freshly treated wood at a controlled equilibrium moisture content level "Equilibrium moisture content" is a term of art which refers to the particular moisture content at which wood is neither gaining nor losing moisture, and the equilibrium moisture content varies with temperature or humidity.

In the process as defined, the minimum wet bulb temperature of the atmosphere can be about 110° F. (about 43° C.). The atmosphere about the wood while the wood is being heated is highly humid or at a saturated moisture level.

In the process as defined, the equilibrium moisture content of the atmosphere about the wood can be maintained above about 10 percent after the wet bulb reaches a temperature of about 110° F. (about 43° C.). In the process as defined, the freshly treated wood is maintained in the equilibrium moisture content controlled atmosphere for a sufficient time to enable the chromated-copper-arsenate to become fixed in the wood.

The fixation of chromated-copper-arsenate (CCA) pressure treated wood can be accelerated without significantly increasing the surface hardness or the degree of checking.

In the process as defined, fixation of the freshly treated wood can be conducted in a chamber having a controlled heat and humidity source. The chamber can be a dry kiln, a fixation chamber or a retort.

In the process as defined, the wood can be a softwood selected from the group consisting of pine, spruce, fir, Douglas fir, cedar, yellow cedar, cyprus, larch and hemlock. In the process as defined, the wood can be a hardwood selected from the group consisting of aspen, poplar wood, cottonwood, encalyptus, maple, birch, beech, oak, hickory, walnut and black lotus.

In the process as defined, the minimum wet bulb temperature can be about 125° F. (about 53° C.). The chromated wood preservative can be a chromated-copper-arsenate or another chromated-copper preservative. The chromated-copper-arsenate can be fixed in the freshly treated wood in less than about twenty-four hours, and in many cases, less than about twelve hours.

DRAWINGS

In drawings which illustrate specific embodiments of the invention, but which should not be construed as restricting or limiting the scope of the invention in any way:

FIG. 1 illustrates a time-temperature graph of wet-bulb, dry-bulb control for charge No. 10; and FIG. 2 illustrates a time-temperature graph of wet-bulb, dry-bulb control for charge No. 11.

DETAILED DESCRIPTION OF SPECIFIC EMBODIMENTS OF THE INVENTION

Figure 1:
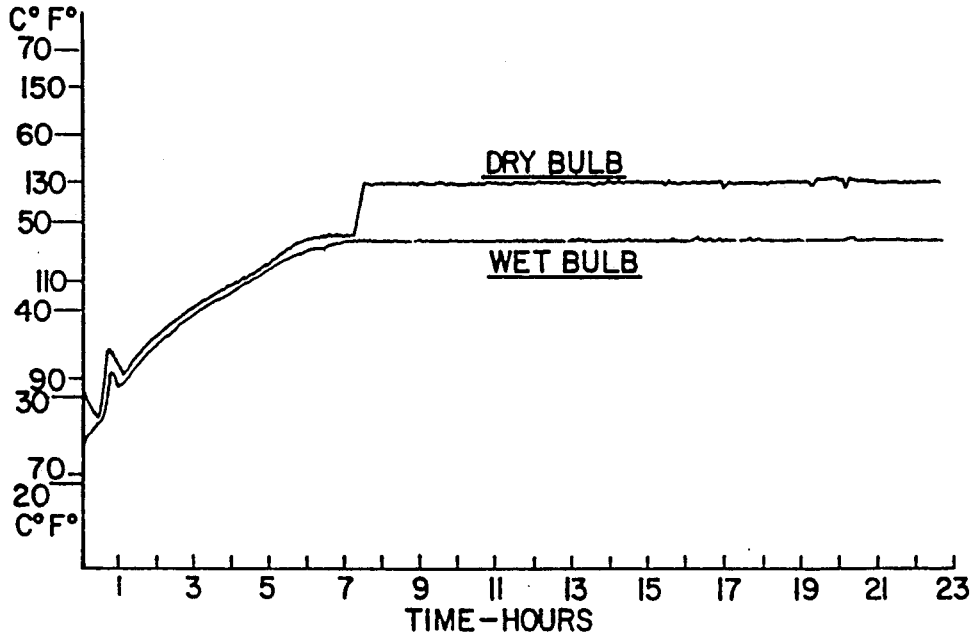

We have discovered a relatively simple inexpensive process for fixing chromated preservatives, notably chromated-copper-arsenate (CCA) on wooden articles, notably softwoods, in a reasonably short period of time. This ensures minimal damage to the environment arising from leaching of imperfectly fixed chromated preservative in treated wooden articles. Another result is reduced inventory costs.

The invention has been developed and verified by conducting a number of studies on lodgepole pine poles used as utility poles. Lodgepole pine poles were cut into 10 ft (3 m) sections for study. These sections were pressure treated with CCA according to conventional techniques and then heated for approximately 24 hours. The results demonstrated that at wet bulb temperatures below about 110 degrees F. (43 degrees C.) and at equilibrium moisture contents below about 10 percent complete fixation of the CCA preservative was not ensured. Fixation of chromated preservative is confirmed by chemical conversion of the chromium from the hexavalent state to the trivalent state. We noted incomplete fixation at the surface of the wood under the described conditions.

In subsequent experiments, matched pressure treated sections were evaluated for the effects of accelerated preservative fixation on surface hardness and checking. The surface hardness of the sections was measured using a 6-J Pilodyn.

MATERIALS AND METHOD

A specially designed insulated chamber 10×12 ft (3.0×3.7 m) with an 8 ft (2.4 m) ceiling, was constructed for the evaluations. The chamber was electrically heated by a 60 kw heater. The internal chamber temperature and humidity were controlled by a Partlow (TM) recording controller which regulated an electrical heater, a steam generator, and a venting system coupled with associated fans.

All preservative treatment was performed in a conventional pressure treatment cylinder. The treating cycle was a modified full cell process. The treating solution concentration was approximately 2.5 percent, for all charges, and the composition corresponded to that specified for CCA-Type C in the Canadian and United States wood preservation standards. The following outline illustrates procedures used.

Eighteen sections were selected for use in each experiment. After labelling and immediately prior to CCA treatment, the physical parameters of each test section were recorded. Measurements recorded included: depth and width of the worst checks (for up to three checks), and surface hardness at six points around the circumference at the mid-point of the section. Immediately prior to treatment, each section was weighed and the moisture content measured using a resistance type moisture meter, fitted with 1.25 in. (31.75 mm) needles.

Following completion of the preservative treatment, the pole sections were removed from the treating retort, weighed and placed on a cart for post treatment fixation. Each layer of sections was stickered to ensure good air circulation. Each layer had four to five pole sections. All processing of the material was undertaken as rapidly as possible to minimize the time between preservative treatment and post treatment fixation. Weighing and loading the pole sections into the chamber, typically took 30 to 45 minutes.

During the sampling process, the sections were cored to provide borings which were used to determine the extent of the CCA fixation. The moisture content was also measured and recorded. Since the cart containing the sections was suspended from the scale during post treatment fixation, the total loss of moisture could be monitored continuously.

All of the sampling was carried out as quickly as possible so that loss of heat from the sections was minimized. The core samples were immediately taken into a quality control laboratory where they were split and the degree of fixation assessed. The procedure for assessing the CCA fixation is outlined below.

The pole sections were then stored in the open to air dry for approximately two months. Following this additional drying the surface hardness was assessed and the depth and width of the three worst checks, recorded.

(A) Determination of hexavalent chromium in CCA-treated wood

When CCA fixes to cellulose, hexavalent chromium in the treatment solution converts to trivalent chromium. Fixation of CCA in treated wood is determined by the conversion of the hexavalent chromium present in the treating solution carrying the CCA to the trivalent form. This conversion is a critical factor governing the performance of the treated product in the field since, during the chemical reaction, the other two components (copper and arsenic) are also rendered insoluble.

The test procedure is based upon the reaction of chromotropic acid (4,5-dihydroxy-2,7-naphthalene disulphonic acid) or its disodium salt, with hexavalent chromium, to produce a pink coloured product. The reagent was prepared by dissolving 0.5 g of chromotropic acid (or the salt) in 100 ml of 1N sulphuric acid.

The borings were split longitudinally and were placed on white absorbent paper. The presence of unconverted chromium was assessed by applying several drops of the chromotropic acid reagent to the split surface of the boring. After approximately 5 minutes, the cores were moved aside and the paper inspected for the presence of a pink colour. The method has a sensitivity of 30 ppm chromium (expressed as $CrO_3$).

(B) Assessment of the preservative leaching

Shavings were removed from the surface of selected pole sections which had been identified by the core sampling as having unfixed chromium at the surface. The shavings were examined and those having a thickness of about 2 mm were carefully ground to produce sawdust.

Following grinding of the wood, 3.0 g of the sawdust was added to 97.0 g of distilled water in a 300 ml beaker. The beaker was carefully shaken for thirty seconds at five minute intervals for one hour after which it was left to stand. After six hours, the beaker was shaken for two minutes. Following 24 hours of leaching, the solution was carefully filtered and analysed.

(C) Assessment of surface hardness

Surface hardness is an important parameter governing the acceptability of poles in the utility pole industry. Increased hardness resulting from CCA treatment makes it more difficult for linemen to climb the poles. The assessment of surface hardness was made using a 6-J Pilodyn. This instrument measured the resistance of the treated wood to the penetration of a 0.1 in. (2.5 mm) diameter steel pin, fired into the pole surface with 6 Joules of energy. The pin penetration provided a direct correlation of the relative surface hardness of the pole. A minimum penetration of 0.4 in. (10 mm) is required for a pole to be rated as acceptable by the industry. Since the 6-J Pilodyn reading is affected by moisture, the results were normalised to a moisture content of 12 percent, to allow comparison of the readings. The 12 percent value was selected because, during summer months, the moisture content can reach this level in the above ground portion of the installed pole.

RESULTS AND DISCUSSION (A) Effect of heat treatment on CCA fixation

Initial experiments using a wet-bulb temperature of (110 degrees F./45 degrees C.) showed that the CCA was almost completely fixed within a 24 hour period. The unfixed hexavalent chromium was located in the surface regions. Lower wet-bulb temperatures (80 degrees F./27 degrees C.) resulted in incomplete fixation after a similar time period. Extending the time to 36 hours still did not lead to complete fixation of the CCA, when using lower wet-bulb temperatures.

The above observations lead the inventors to several important conclusions. The first is that under normal storage conditions, which would be below 80 degrees F. (27 degrees C.), fixation of the CCA is much slower than anticipated, and is unlikely to be accomplished within the 48 hour storage period often recommended to wood treating companies. Indeed, during winter operations in northern climates, the time for complete conversion of the chromium will clearly be several weeks and could even be several months.

The second conclusion is that if the wood is allowed to dry without controlling the equilibrium moisture content (EMC), fixation at the surface of the wood is incomplete. If the equilibrium moisture content (EMC) is maintained at a high level, the drying will proceed slowly, even though the temperature of the wood is high. Under these conditions, the CCA fixation will proceed rapidly and completely. However, at low temperatures, and low EMC, the fixation reaction will proceed slowly.

A third conclusion from these tests was that a wet-bulb temperature higher than 110 degrees F. (43 degrees C.) will be required to convert the chromium in 24 hours. In addition, a high humidity will be required in order to ensure that the moisture content at the wood surface is sufficient to allow the fixation to occur. Lastly, the equilibrium moisture content of the atmosphere around the wood should be maintained at 10 percent or greater.

(B) Effect of heat treatment on the preservative fixation, surface hardness and checking (i) Preservative Fixation Conditions for the six charges used to develop preservative fixation information are summarized in Table 1.

TABLE 1

Conditions for Charges to Evaluate Temperature and Moisture Requirements for CCA Fixation.

| Charge No. | Dry Bulb Degrees F. (Degrees C.) | Wet Bulb Degrees F. (Degrees C.) | Surface E.M.C. | Hours | Fixation Complete Core/Tip* |
|---|---|---|---|---|---|
| 10 | 120 (49) | 119 (48) | 15–21 | 6 | 18/16 |
| | 130 (54) | 119 (48) | 11 | 19 | |
| 11 | 120 (49) | 119 (48) | 11–21 | 6 | 18/16 |
| | 130 (54) | 119 (48) | 12 | 19 | |
| 12 | Air Dried | | | | 18/1 |
| 13 | 160 (71) | 150 (66) | 10–12 | 7 | 18/18 |
| | 150 (66) | 135 (57) | 12 | 17 | |
| 14 | 150 (66) | 140 (60) | 10–12 | 24 | 18/18 |
| 15 | 130 (54) | 111 (43) | 10–12 | 19 | 18/12 |

Note: E.M.C. = Equilibrium Moisture Content;
*Tip = 0–2 mm thickness of core measured from the wood surface.

Charges 10 and 11 were the first used to illustrate the value of using higher wet bulb temperatures.

Charge 10: In charge 10 the atmosphere was initially heated to 119° F. (48° C.) wet bulb and 120° F. (49° C.) dry bulb. Manual control of the heat source allowed the wet bulb temperature to be the controlling temperature. Wet steam was continuously injected into the atmosphere and heat was added as required to keep the equilibrium moisture content (EMC) at 20 percent or higher. This achieved as near as practical a saturated atmosphere. After set point temperatures were achieved, 119° F. (48° C.) wet bulb was maintained for the duration of the test. The EMC was kept above 10 percent.

Charge 11: The same temperatures as in charge 10 were used. During heating the dry bulb temperature was used as the controlling temperature. Wet steam was continuously injected into the atmosphere. The resulting atmosphere was highly humid maintaining at all times a wet surface on the samples being tested. After set point temperatures were achieved, 119° F. (48° C.) wet bulb was maintained for the duration of the test and the EMC was kept above 10 percent.

Fixation of the CCA based upon the conversion of the hexavalent chromium was complete in sixteen of the eighteen pole sections making up the sample for charges 10 and 11.

Charge 13 followed closely charge 11 except for the higher temperatures. 150° F. wet bulb (66° C.) 160° F. dry bulb (71° C.). Wet steam was continuously provided until set points were achieved. The equilibrium moisture content (EMC) was kept above 10 percent EMC Fixation of Chromium was complete in eighteen of the eighteen pole sections making up the test sample.

Charge 14 duplicated charge 13 and fully confirmed the Fixation of the CCA in that all Chromium eighteen pole sections in the charge showed complete conversion of the chromium.

Charge 15 was similar to charge 11 but with reduced set point temperatures 111° F. wet bulb 44° C. The resulting test on the conversion of the chromium showed that only twelve of the sections were used out of the eighteen sections making up the test sample. Thus it may be concluded that while some degree of success can be achieved with wet bulb temperatures of approximately 111° F. (43° C.), and a minimum equilibrium moisture content of 10 percent a higher wet bulb temperature of 125°-140° F. (57° to 60° C.) together with an equilibrium moisture content of 10 percent would be preferred to ensure complete fixation of the CCA.

Figure 2:
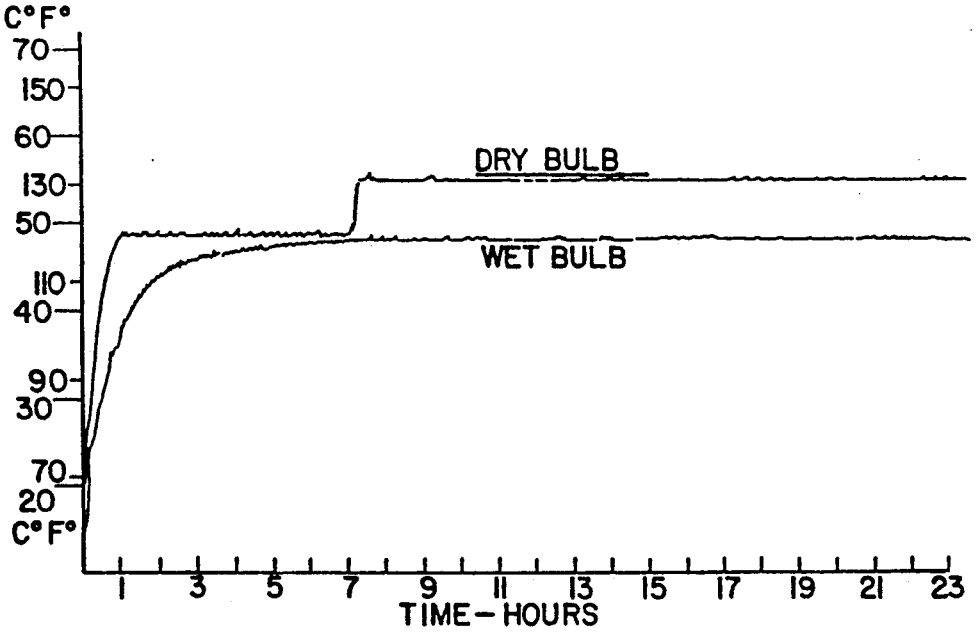

FIG. 1 illustrates graphically on time and temperature coordinates wet and dry bulb plots for charge 10. FIG. 2 illustrates graphically on time-temperature coordinates wet and dry bulb plots for charge 11. Temperatures for dry bulb and wet bulb were increased steadily during the early hours and were held steady at about 130° F. dry bulb and about 120° F. wet bulb during the latter hours for each charge.

(ii) Surface Hardness.

The surface hardness of the pole material is effected by three factors. The first of these is the wood density. The second is the CCA treatment, which is known to increase the surface hardness. The third factor is post treatment since it has been suggested that this process also leads to an increase in the hardness.

The results for the hardness investigation are summarised in Table 2.

TABLE 2

Pilodyn Surface Hardness Measurements.

| Charge No. | Pilodyn Measurement (mm) Before Preservative Treatment | After Heating and Air drying |
|---|---|---|
| 10 | 16.0 | 12.6 |
| 11 | 15.0 | 13.0 |
| 12 | 13.9 | 12.8 |
| 13 | 13.0 | 11.5 |

Note - Air drying = air seasoning for two months.
Charge 12 was air-dried only

It is clear from the hardness results that the CCA treated pole sections are indeed harder than the original untreated stock. Inspection of the data after heat treatment and air conditioning shows that several of the normalized Pilodyn readings approach or are less than 0.4 in. (10 mm). This is important since poles with Pilodyn readings below 0.4 in. (10 mm) are considered to be too hard for linemen to climb safely. In general, most of the values are greater than 0.4 in. (11 mm).

A comparison of the results of charge Nos. 10 and 11 with those for charge No. 12 is particularly valuable, since the latter were air dried after treatment while the former were heat treated for 25 hours to achieve fixation after which they were allowed to air dry. The Pilodyn results in Table 2 show very clearly that there was no difference in the final surface hardness of the sections. The data for charge No. 13 has been included since it allows further confirmation of the results recorded for charge Nos. 10 and 11. It should be noted that, whereas charge Nos. 10, 11 and 12 were for matched material, charge No. 13 was based on sections prepared from a different supply. Therefore it is not possible to compare the data for charge No. 13 with that from the three earlier charges.

It was concluded from the foregoing that the CCA-treated poles are equally hard whether they are heat treated for 25 hours to fix the preservative, or whether they are allowed to air dry.

(iii) Checking

It can be concluded that the degree of checking was not effected by the post treatment conditioning method, since the check widths for the CCA-treated sections which were heated were not significantly different from those measured in the sections which were allowed to air dry after the pressure treatment.

Following the completion of the study, the sections were cross cut and the freshly cut surface sprayed with chrome azurol S, to indicate the CCA preservative penetration. Inspection of the sprayed surface showed that the checks rarely penetrated beyond the depth of the treatment. In almost all cases, the preservative had penetrated into the deepest check to provide an integral shell of protection. This is essential if the treatment is to be effective in protecting the pole in service. It was also concluded from a visual inspection, that there was no difference between checking characteristics of the heat post treatment and air dried pole section.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A process for fixing a chromated-preservative in wood freshly treated with said preservative which comprises placing the preservative treated wood in an atmosphere which is at a temperature of at least about 110° F. wet bulb and below about 150° F. wet bulb and highly humid with water vapor, and maintaining the atmosphere about the freshly treated wood at a temperature of at least about 110° F. wet bulb and below about 150° F. wet bulb and at a controlled equilibrium moisture content level above about 10% until the preservative becomes fixed.

2. A process as claimed in claim 1 wherein the atmosphere about the wood when the wood is placed in the atmosphere is at a saturated with water vapor moisture level.

3. A process as claimed in claim 1 wherein the chromated-preservative is fixed in the freshly treated wood in less than twenty-four hours.

4. A process as claimed in claim 1 wherein the chromated-preservative is fixed in the freshly treated wood in less than twelve hours.

5. A process as claimed in claim 1 wherein the chromated-preservative contains hexavalent chromium which is converted to trivalent chromium upon fixation.

6. A process as claimed in claim 1 wherein the preservative is chromated-copper-arsenate and the freshly treated wood is maintained in the equilibrium moisture content controlled atmosphere for a sufficient time to enable the chromated-copper-arsenate to become fixed in the wood.

7. A process as claimed in claim 1 wherein fixation of the freshly treated wood is conducted in a chamber having a suitably controlled heat and humidity source.

8. A process as claimed in claim 7 wherein the chamber is a dry kiln, a fixation chamber or a retort.

9. A process as claimed in claim 1 wherein the wood is a softwood.

10. A process as claimed in claim 9 wherein the wood is selected from the group consisting of pine, spruce, fir, Douglas fir, cedar, yellow cedar, cyprus, larch and hemlock.

11. A process as claimed in claim 1 wherein the wood is a hardwood.

12. A process as claimed in claim 11 wherein the wood is selected from the group consisting of aspen, poplar wood, cottonwood, eucalyptus, maple, birch, beech, oak, hickory, walnut and black lotus.

13. A process as claimed in claim 1 wherein the wet bulb temperature in the atmosphere about the freshly treated wood is at least about 125° F. (about 53° C.).

14. A process as claimed in claim 1 wherein the chromated wood preservative is a chromated-copper-arsenate.

15. A process as claimed in claim 1 wherein the chromated wood preservative is a chromated-copper-arsenate dissolved in water.

* * * * *